US007172163B1

(12) United States Patent
Johnson

(10) Patent No.: US 7,172,163 B1
(45) Date of Patent: Feb. 6, 2007

(54) MAILBOX HOLDER

(76) Inventor: Dan F. Johnson, 630 E. Franklin St., Lanark, IL (US) 61046

( * ) Notice: Subject to any disclaimer, the term of this patent is extended or adjusted under 35 U.S.C. 154(b) by 308 days.

(21) Appl. No.: 10/951,581

(22) Filed: Sep. 29, 2004

(51) Int. Cl.
*A47G 23/02* (2006.01)

(52) U.S. Cl. ..... 248/146; 248/156; 248/545; 52/296; 40/607.05; 232/39

(58) Field of Classification Search ..... 248/146, 248/188.1, 156, 152, 530, 122, 545, 121, 248/548; 52/296, 165, 98; 40/607.05, 607.06, 40/607.08, 607.09, 739; 232/39
See application file for complete search history.

(56) References Cited

U.S. PATENT DOCUMENTS

| | | | | | |
|---|---|---|---|---|---|
| 1,281,062 | A | | 10/1918 | Norvell | |
| 1,735,722 | A | * | 11/1929 | Beard | 52/168 |
| 2,149,050 | A | | 2/1939 | Hajicek | |
| 2,552,915 | A | * | 5/1951 | Zachrich | 248/154 |
| 3,250,032 | A | * | 5/1966 | Von Gal, Jr. | 40/493 |
| 3,499,630 | A | * | 3/1970 | Dashio | 256/13.1 |
| 3,827,626 | A | | 8/1974 | Daigle | |
| 3,870,262 | A | | 3/1975 | Manning, Jr. | |
| 4,213,560 | A | | 7/1980 | Hall | |
| 4,249,715 | A | * | 2/1981 | Repp | 248/545 |
| 4,395,012 | A | | 7/1983 | Rance | |
| 4,500,146 | A | * | 2/1985 | Peterson | 312/257.1 |
| 4,709,853 | A | * | 12/1987 | Hahn | 232/39 |
| 4,759,161 | A | * | 7/1988 | Kucyk, Jr. et al. | 52/99 |
| 4,792,088 | A | | 12/1988 | Bonnell | |
| 4,926,592 | A | * | 5/1990 | Nehls | 52/98 |
| 4,951,905 | A | * | 8/1990 | Bronson et al. | 248/152 |
| 5,207,405 | A | * | 5/1993 | Cobb | 248/411 |
| D338,765 | S | | 8/1993 | Hohlbein | |
| 5,429,336 | A | * | 7/1995 | Ko | 248/278.1 |
| 5,524,853 | A | * | 6/1996 | Varlaro | 248/145 |
| 5,678,757 | A | * | 10/1997 | Martin | 232/17 |
| 5,713,514 | A | | 2/1998 | Eck | |
| 5,797,213 | A | * | 8/1998 | Frick | 43/54.1 |
| 6,343,446 | B1 | * | 2/2002 | Beard | 52/165 |
| 6,543,680 | B1 | * | 4/2003 | McCormack | 232/39 |
| 6,722,821 | B1 | * | 4/2004 | Perko et al. | 405/249 |

* cited by examiner

*Primary Examiner*—Kimbelry Wood

(57) ABSTRACT

A mailbox holder (10) includes an upper mailbox support (14), a lower ground support (16) that is securely fastened to the upper support, and an attachment bracket (36) to which a mailbox (12) is secured. The upper mailbox support includes a vertical post (20), a horizontal arm (22) rigidly welded to the post to carry the mailbox, a diagonal support (24) welded between the horizontal arm and the vertical post, and a circular bolt flange (26) welded to the bottom of the post. The lower ground support includes a vertical stake (28) adapted for direct insertion into the ground, a circular bolt flange (30) welded to the top of the stake for connection to the upper support flange, and radially outwardly extending stabilizers (32) to resist movement of the support in the ground. The bracket is adjustable in width to accommodate mailboxes of different widths.

10 Claims, 5 Drawing Sheets

MAILBOX HOLDER

CROSS-REFERENCES TO RELATED APPLICATIONS

None

REFERENCE TO SEQUENCE LISTING, TABLE, OR COMPUTER PROGRAM LISTING APPENDIX SUBMITTED ON A COMPACT DISC

Not Applicable.

STATEMENT REGARDING FEDERALLY SPONSORED RESEARCH OR DEVELOPMENT

Not Applicable.

BACKGROUND OF THE INVENTION

1. Field of Invention

The present invention relates generally to mailbox holders.

More particularly, the invention relates to free-standing mailbox holders of a type suitable to carry a mailbox at a roadside location.

2. Description of Prior Art

Simple, traditional mailbox holders intended for roadside use often consist of a post secured in the ground with a horizontal support arm to which a mailbox is attached. These and other unitary-type mailbox holders are easily damaged and may require replacement of the entire unit if hit by, for example, a motor vehicle, or damaged from mischievous or malicious activity.

Some roadside mailbox holders are arranged to provide limited movement or play in the mailbox support, and thereby be somewhat forgiving in the event they are hit by a vehicle or otherwise. Such strike-forgiving mailbox holders tend to be either ineffective, or relatively complicated and expensive, and the play in such holders can compromise unit integrity.

Still other roadside mailbox holders are intended to breakaway from a base located in the ground in the event of a vehicle strike. These types of holders also tend to be relatively complicated and expensive, and very few installations ever require such breakaway capability.

Installation of these and other prior mailbox holders typically requires digging a hole in the ground, positioning the post into the hole, and then re-filling the hole with dirt around the post. This process is, at best, inconvenient, and may be difficult to impossible such as in rocky-ground conditions or during the middle of the winter. Prior mailbox holders set directly into the ground also tend to lean, raise up, or otherwise shift and move around over a period of time, due to extreme hot-cold temperatures, ground freeze-thaw cycles, wind, rain, and other changing weather conditions. To prevent such shifting or movement over time, the mailbox holder post may be set in concrete in the ground. However, because reuse of the concrete base is generally impossible, and removal of the concrete base can be difficult, a new hole is typically require to replace a damaged mailbox holder.

SUMMARY OF THE INVENTION

The general aim of the present invention is to provide a new and improved mailbox holder suitable for roadside use, the mailbox holder being uniquely adapted for durability and ease of assembly and installation into the ground, and that is cost effective to manufacture.

A detailed objective of the invention is to provide a mailbox holder constructed from two parts—a lower support with an integral stake for insertion into the ground, and an upper support that is secured to the lower support after installation into the ground, the upper support being adapted to carry the mailbox. This arrangement enables removal and replacement of the upper support without disturbing the lower ground support. This arrangement is further advantageous because a two-part mailbox holder can be typically manufactured and shipped at less cost than manufacture and shipment of a similarly constructed one-piece unit, the lower stake configuration promotes ease of installation into the ground, with no digging or concrete required, the upper support is easily removed for maintenance, transportation or replacement in the event of damage, and replacement of the upper support will be less expensive and easier than replacement of the entire mailbox holder.

Another detailed objective is to provide a mailbox holder that is of sturdy metal, tubular construction, including bolt-together face-to-face mating flanges between the upper and lower supports, and use of high-strength bolts to prevent the upper support from easily breaking away from the lower support. The heavy duty construction ensures long term durability of the holder. Contrary to certain prior mailbox holders, the mating flanges of the present invention are not intended for ease of breakaway, but rather are intended to resist breakaway from a strike against the upper support, substantially equally in all directions. The tubular design of ground stake with a flange in the form of a heavy duty top plate permits installation with a heavy hammer and results in a more stable unit. And providing a flange that maintains its integrity in the event of a typical strike against the upper holder insures that the post stands firm against unnecessary or accidental breakaway and against malicious damage.

Yet another detailed objective of the invention is to provide a mailbox holder with a bracket that is adjustable for attachment of mailboxes of different widths.

Still another detailed objective of the invention is to provide a mailbox holder bracket that is adjustable for attachment of mailboxes of different widths and may be generally used with mailbox holders having a horizontal arm to carry the mailbox.

These and other objectives and advantages of the invention will become more apparent from the following detailed description when taken in conjunction with the accompanying drawings.

Figure 1:
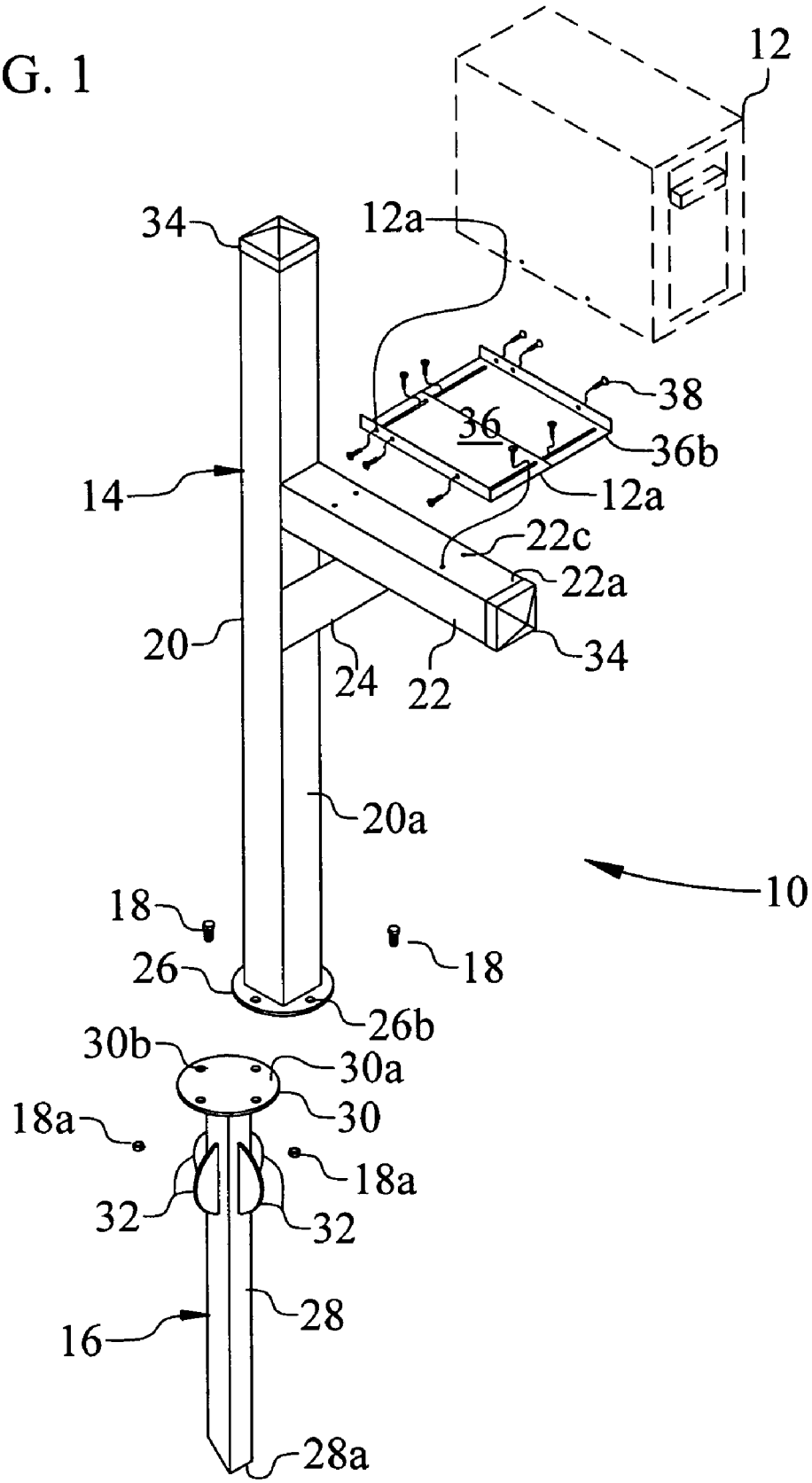
FIG. 1 is an exploded perspective view of a new and improved mailbox holder incorporating the unique aspects of the present invention, and showing a mailbox in dashed lines.
Figure 4:
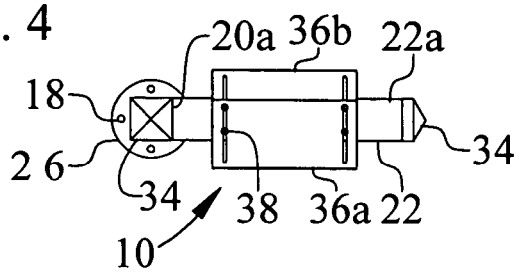
FIG. 4 is a top view of the mailbox holder assembled together and installed into the ground.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

Reference numerals in the drawings correspond to the following items discussed further below:

| | |
|---|---|
| 10 | mailbox holder |
| 12 | mailbox |
| 12a | holes |
| 14 | upper mailbox support |
| 16 | lower ground support |
| 18 | high-strength threaded bolts |
| 18a | threaded nuts |
| 20 | vertical post |
| 20a | front side |
| 22 | horizontal arm |
| 22a | upper horizontal surface |
| 22b | bottom surface |
| 22c | drilled (non-threaded) screw holes |
| 24 | welded diagonal support member |
| 26 | circular flange |
| 26a | flat bottom of flange |
| 26b | bolt holes |
| 28 | vertical stake |
| 28a | pointed terminal end |
| 30 | circular flange |
| 30a | top of flange |
| 30b | bolt holes |
| 30c | bottom of flange |
| 32 | semi-circular stabilizers |
| 34 | metal caps |
| 36 | adjustable mailbox attachment bracket |
| 36a | left side angle-bracket |
| 36b | right side angle-bracket |
| 36c | plate |
| 36d | flange |
| 36e | slots |
| 36f | screw holes |
| 36g | inside edges |
| 36h | outer sides |
| 38 | screws (e.g., self-taping) |

DETAILED DESCRIPTION OF THE INVENTION

For purposes of illustration, the present invention is shown in the drawings as mailbox holder 10 (FIGS. 1–4) for holding a mailbox 12 shown in dashed lines.

The mailbox holder 10 includes an upper mailbox support 14 and a lower ground support 16 that are securely, yet releasably fastened together with high-strength threaded bolts 18 and threaded nuts 18*a*. The mailbox holder 10 also includes a mailbox attachment bracket 36 that is adjustable for use with mailboxes of different widths.

The upper mailbox support 14 (FIGS. 5–9) includes a vertical post 20, and a horizontal arm 22 welded (or otherwise rigidly secured) to and extending forwardly from the front side 20*a* of the upper portion of the vertical post 20 to position the mailbox at a height range above ground such as specified as standard mailbox height by the U.S. postal service. A diagonal support 24 is welded at an angle between the bottom surface 22*b* of the horizontal arm 22 and the front side 20*a* of the vertical post 20. In preferred embodiments, the post 20, the arm 22 and the diagonal support 24 are fabricated from relatively stiff, thick-wall metal tubing, and a cap 34 is glued or otherwise secured to the open ends of the post 20 and the arm 22. A circular flange 26 is welded to and extends horizontally outwardly from the bottom of the vertical post 20. The flange 26 is provided with a flat lower terminal surface to establish a flat bottom 26*a* of the upper support 14, and bolt holes 26*b* that extend vertically through the thickness of the flange and which are equally angularly spaced on a constant bolt circle diameter around the flange. The flange is preferably fabricated from relatively stiff, solid metal plate.

The lower ground support 16 (FIGS. 10–14) includes a vertical stake 28 with a lower end that tapers to a pointed terminal end 28*a*, and a circular flange 30 that is welded to and extends horizontal outwardly from the top of the post 28. The flange 30 is provided with a flat upper terminal surface to establish a flat top 30*a* of the lower support, and bolt holes 30*b* that extend vertically through the thickness of the flange and which are equal angularly spacing at the same bolt circle diameter as the bolt holes 26*b* in the upper flange 26 for alignment therewith. The lower support 16 further includes vertical semi-circular stabilizers 32 welded to the upper portion of the post 28, centered at between approximately one-half to three-fourths up the height of the stake. The stabilizers 32 are equally angularly spaced from one another, and extend vertically along the outer sides of the stake and outwardly therefrom with respect to the center of the stake. In preferred embodiments, four stabilizers are provided spaced at approximately 90 degrees, and extend to approximately the same position from the stake as the diameter of the flange 30. Further, the stake is preferably fabricated from relatively stiff, thick-wall metal tubing, and the flange 30 and stabilizers 32 are fabricated from relatively stiff, solid metal plate.

Figure 16:
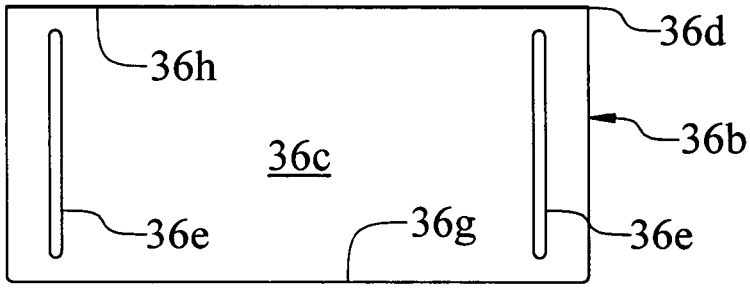
FIG. 16 is a top view of the right side angle-bracket of the adjustable mailbox attachment bracket, the right side view being a mirror image thereof, and the left side angle-bracket being a mirror image of the right side angle-bracket.
Figure 17:
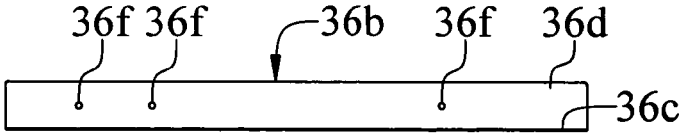
FIG. 17 is a left side view of the right side angle-bracket.
Figure 18:
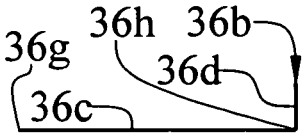
FIG. 18 is a front view of the right side angle-bracket.

The mailbox attachment bracket 36 (FIGS. 15–18) includes two laterally spaced vertical flange members 36*d* that are laterally adjustable for attachment to the sides of mailboxes of different widths. In the embodiment shown, the attachment bracket includes a left side angle-bracket 36*a* and a right side angle-bracket 36*b*. Enlarged views of the left side angle-bracket 36*a* are shown in FIGS. 16–18. The construction of the right-side angle-bracket mirrors the left side angle-bracket. In this instance, the angle-brackets 36*a* and 36*b* are each formed with horizontal, generally flat or planar bottom plate-like members 36*c* with inside edges 36*g* and outer sides 36*h*. Side flanges 36*d* extend vertically from the outer sides 36*h* to establish a horizontal space to receive the bottom portion of the mailbox therebetween. Cross-wise extending, spaced slots 36*e* are formed in the bottom plates 36*c*, and a set of clearance holes 36*f* are formed through the side flanges 36*d*. The angle-brackets are secured to the top of the arm 22 with self-tapping screws 38 (see FIGS. 1–2) extending through the aligned slots and threading into holes 22*c* pre-drilled in the top surface of the arm 22. The cross-wise slots permit sliding the angle-brackets towards and away from one another on the support arm, to decrease and increase the space between the side flanges, and enable a snug fit to the sides of mailboxes of different widths.

Figure 2:
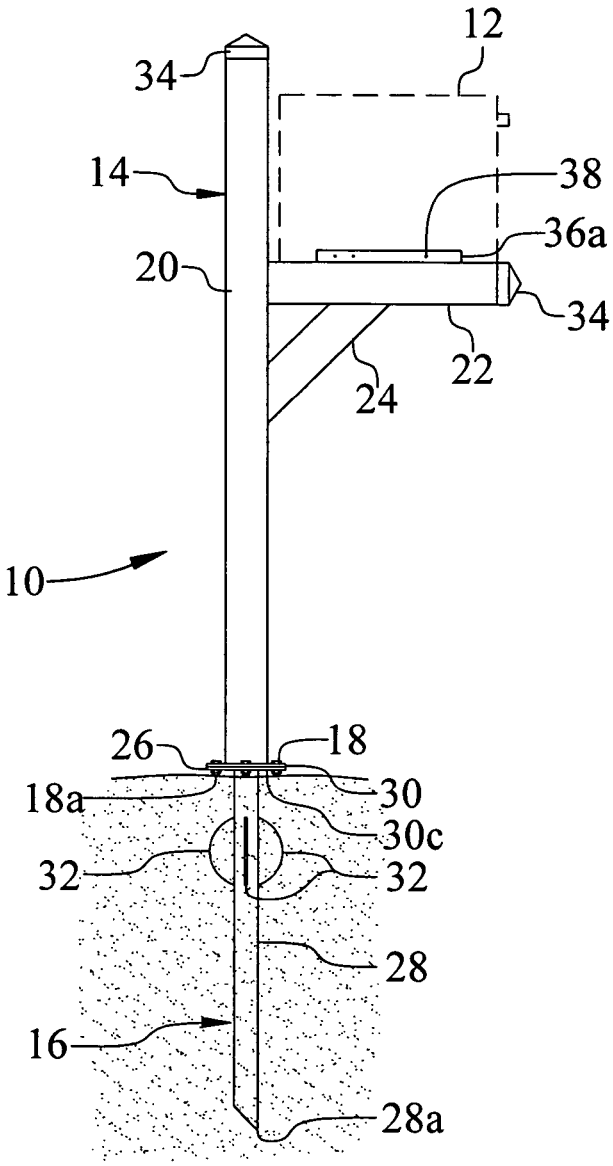
FIG. 2 is a side view of the mailbox holder assembled together and installed into the ground.
Figure 3:
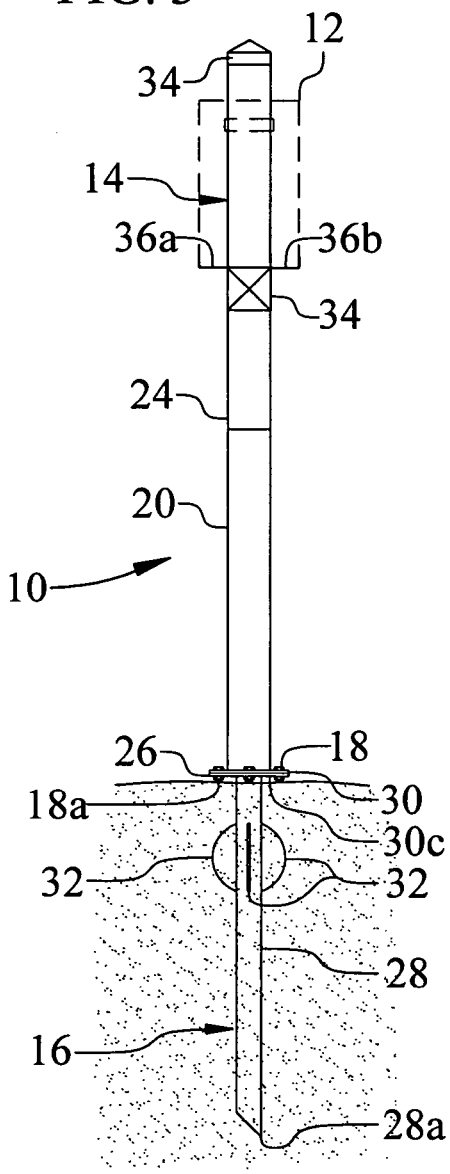
FIG. 3 is front view of the mailbox holder assembled together and installed into the ground.
Figure 8:
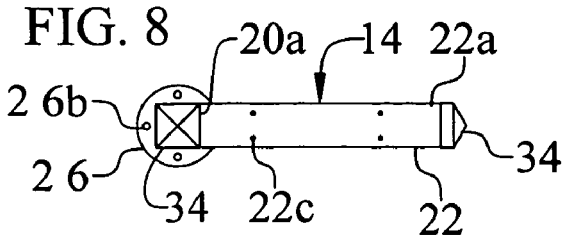
FIG. 8 is a top view of the upper mailbox support.
Figure 5:
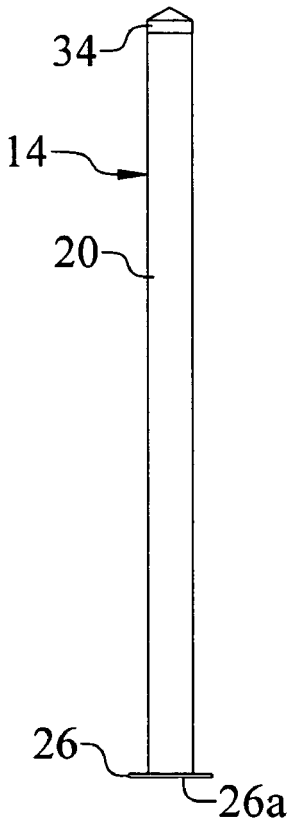
FIG. 5 is a back view of the upper mailbox support of the mailbox holder shown in FIGS. 1–4.
Figure 6:
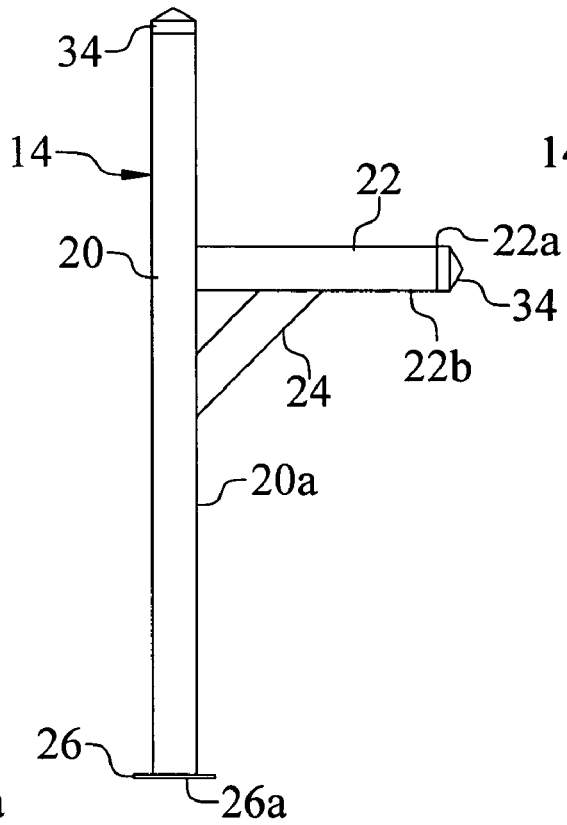
FIG. 6 is a left side view of the upper mailbox support, the right side view being a mirror image thereof.
Figure 7:
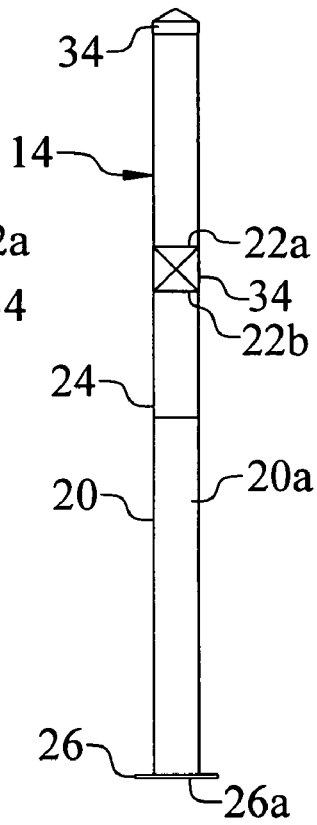
FIG. 7 is a front view of the upper mailbox support.
Figure 9:
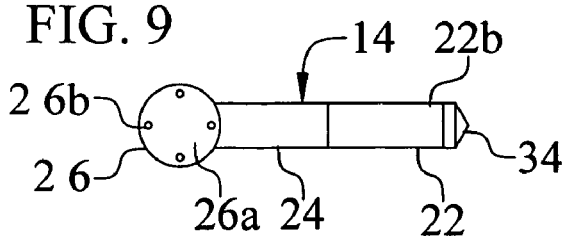
FIG. 9 is a bottom view of the upper mailbox support.
Figure 13:
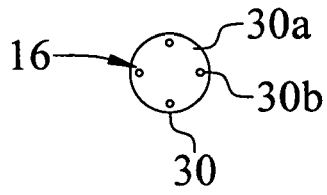
FIG. 13 is a top view of the lower ground support.
Figure 10:
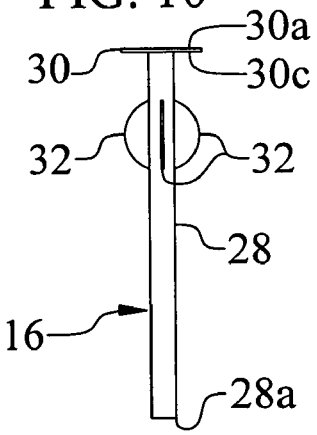
FIG. 10 is a back view of the lower ground support of the mailbox holder shown in FIGS. 1–4.
Figure 11:
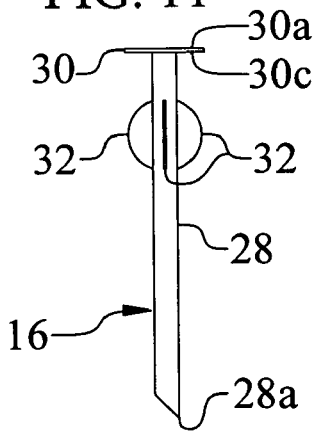
FIG. 11 is a left side view of the lower ground support, the right side view being a mirror image thereof.
Figure 12:
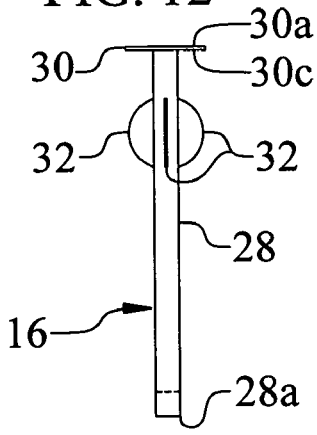
FIG. 12 is a front view of the lower ground support.
Figure 14:
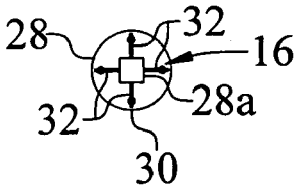
FIG. 14 is a bottom view of the lower ground support.
Figure 15:
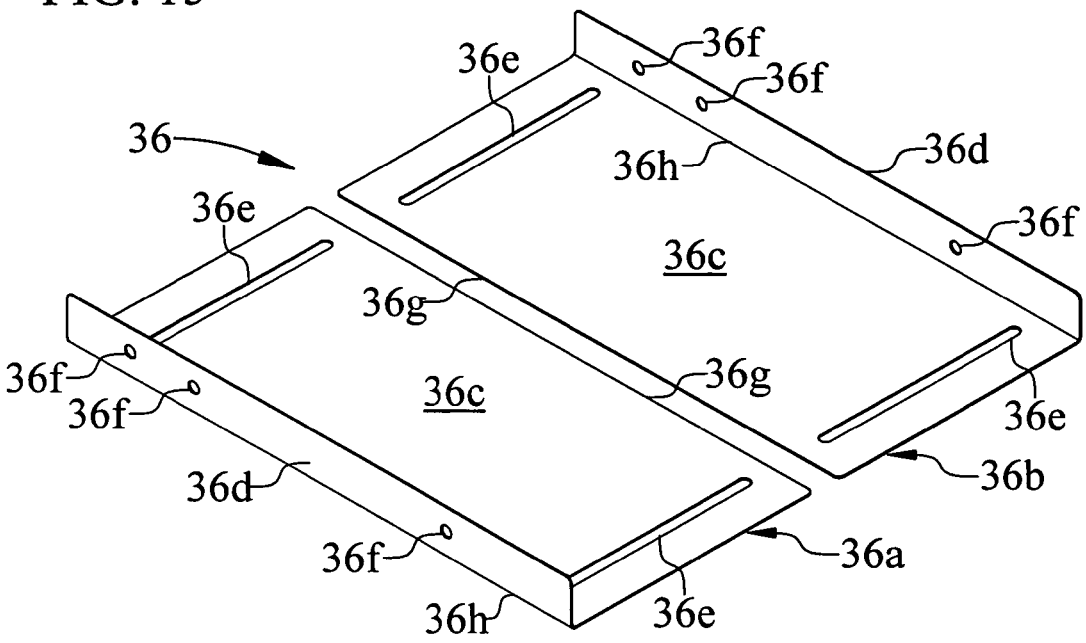
FIG. 15 is a perspective view of the adjustable mailbox attachment bracket shown in FIGS. 1–4.

To install the mailbox holder 10, the stake 16 is inserted into the ground to a depth that positions the bottom surface 30*c* of the flange 30 approximately one to two inches above the ground (see FIGS. 2–3). This may be accomplished by, for example, hammering onto the top of the flange to drive the stake into the ground. The bottom 26*a* of the upper mating flange 26 is then positioned in face-to-face relation onto the top 30*a* of the lower mating flange 30, and the upper mailbox support 14 is secured to the lower support 16 with threaded bolts 18, installed through the aligned bolt holes 26*b*, 30*b* in the flanges, and threaded nuts 18*a*. The adjustable mailbox attachment bracket is adjusted (i.e., the space or opening between the side flanges 36*d* of the side angle-brackets is adjusted) by sliding the angle-brackets towards or away from one another to obtain a snug fit with the sides of the mailbox, 12, and secured in the adjusted position to the upper mailbox support 14 with screws 38 through slots 36*e* and holes 22*c*. The mailbox 12 is secured into position on the bottom plates 36*c* and to the side flanges 36*d* of the attachment bracket 36 with self-tapping screws 38 installed through the holes 36*f* and into the lower side holes 12*a* located on each side of the mailbox. The lower sides of many mailboxes are provided with pre-drilled holes at generally standard, predefined spacing. The preferred spacing of the clearance holes 36*f* in the sides 36*d* of the angle-brackets 36*a*, 36*b* corresponds with the standard spacing of the pre-drilled holes in the mailbox.

Advantageously, the tapered end 28*a* of the ground support 16 enables direct insertion into the ground without having to pre-dig a hole for receiving the support, and the flange 30 enables manually driving the stake into the ground. The circular mating flanges 26, 30, secured directly and solidly together in face-to-face relation, with high-strength bolts at equal and relatively high angular spacing on constant bolt circle diameter, provide approximately equal resistance to breakaway of the upper holder from the ground stake in all directions. The releasable connection between the upper and lower supports enables removal and replacement of the upper support as desired, such as if damaged by a motor vehicle strike or for routine maintenance purposes. The stabilizers 32 provide enhanced resistance against turning and twisting of the stake 16 in the ground, and thus establish enhanced resistance to prevent the stake from pivoting out of the ground from a strike on the upper support 14. The stabilizers also provide enhanced resistance to movement, leaning or shifting of the holder from side to side over time due to changing ambient conditions, changes in hot-to-cold extreme temperature, wind, and ground freeze and thaw cycles. Provision of four stabilizers equally spaced around the post 28 establishes approximately equal resistance to pivoting, turning, leaning, etc. of the post due to such forces from all directions. An alternate number of stabilizers may be provided, such as between three to five stabilizers. However, four stabilizers is preferred because of reduced resistance to movement of three stabilizers of the same size, and because of the added cost of five stabilizers of the same size. Provision of the laterally adjustable attachment bracket 36 enables establishing a snug and secure fit to mailboxes of different widths. And the adjustable attachment bracket may be used with other mailbox holders that include a horizontal arm typically extending forwardly from a vertical post.

I claim:

1. A mailbox holder comprising:

a) an upper support with i) a vertical post fabricated from metal tubing, the post having an upper portion with a front side and having a lower end, ii) a horizontal arm fabricated from metal tubing, the arm being welded to the upper portion of the vertical post, the arm extending forwardly from the front side of the post, the arm having a top side and a bottom side, iii) a pair of caps secured to the open tubular ends of the post and the arm, iv) a diagonal support fabricated from metal tubing, the diagonal support being welded at an angle between the front side of the post and the bottom side of the arm, and v) an upper flange fabricated from solid metal plate, the upper flange being welded to the lower end of the post, the upper flange extending horizontally outwardly from the post and having a circular outer profile when viewed from above, the upper flange being provided with a flat bottom and bolt clearance holes, the bolt clearance holes being equally angularly spaced on a constant bolt circle diameter and extending through the thickness of the flange;

b) a lower support with i) a vertical stake fabricated from metal tubing, the stake having an upper end and a lower end, the lower end of the stake tapering to a pointed terminal end, ii) a lower flange fabricated from solid metal plate, the lower flange being welded to the upper end of the stake, the lower flange extending horizontally outwardly from the stake and having a circular profile when viewed from above, the lower flange being provided with a flat top in face-to-face contacting relation with the flat bottom of the upper flange, the lower flange being provided with bolt clearance holes extending through the thickness of the flange and aligned with the bolt clearance holes in the upper flange, and iii) at least four ground stabilizers welded at equal angular spacing to the upper half of the stake, the stabilizers extending vertical along the sides of the stake and outwardly from the stake in a generally radial direction with respect to the center of the stake; and c) high strength threaded bolts installed through the aligned bolt clearance holes of the upper and lower flanges, and threaded nuts tightened onto the bolts for rigidly securing the flanges and the upper and lower supports together.

2. The mailbox holder as defined in claim 1 in which the stabilizers extend outwardly from the stake to approximately the circular diameter of the flange when viewed from above.

3. The mailbox holder as defined in claim 1 in which the stabilizers have a semi-circular profile when viewed from the side.

4. A mailbox holder comprising:

a) a vertical post having an upper portion and having a lower end secured in relation to the ground;

b) a horizontal arm secured to and extending forwardly from the upper portion of the vertical post; and c) an adjustable mailbox attachment bracket with left and right hand angle-brackets comprising (i) horizontal plates with inside edges and outside edges and (ii) left and right vertical flanges secured to the outside edges of the plates, the vertical flanges provided with clearance holes to receive threaded fasteners for securing the vertical flanges to opposite sides of a mailbox, the plates having front and back sets of cross-wise slots, the plates being secured to the arm with fasteners installed through said slots and into the arm for sliding movement of the vertical flanges towards and away from one another to accommodate mailboxes of different widths.

5. A mailbox holder comprising:

a) an upper support with i) a vertical post having an upper portion with a front side and having a lower end, ii) a horizontal arm rigidly secured to the upper portion of the vertical post, the arm extending forwardly from the front side of the post, the arm having a top side and a bottom side, iii) a diagonal support rigidly secured at an angle between the front side of the post and the bottom side of the arm, and iv) an upper flange rigidly secured to the lower end of the post, the upper flange extending horizontally outwardly from the post and having a circular outer profile when viewed from above, the upper flange being provided with a flat bottom and bolt clearance holes, the bolt clearance holes being equally angularly spaced on a constant bolt circle diameter and extending through the thickness of the flange;

b) a lower support with i) a vertical stake having an upper end and a lower end, the lower end of the stake tapering to a pointed terminal end, ii) a lower flange rigidly secured to the upper end of the stake, the lower flange extending horizontally outwardly from the stake and having a circular profile when viewed from above, the lower flange being provided with a flat top in face-to-face contacting relation with the flat bottom of the upper flange, the lower flange being provided with bolt clearance holes extending through the thickness of the flange and aligned with the bolt clearance holes in the upper flange, and iii) at least three ground stabilizers rigidly secured at equal angular spacing to the upper half of the stake, the stabilizers extending vertical along the sides of the stake and outwardly from the stake in a generally radial direction with respect to the center of the stake;

c) high strength threaded bolts installed through the aligned bolt clearance holes of the upper and lower flanges, and threaded nuts tightened onto the bolts for rigidly securing the flanges and the upper and lower supports together; and d) an adjustable mailbox attachment bracket with left and right side vertical flanges provided with clearance holes to receive threaded fasteners for securing the vertical flanges to opposite sides of a mailbox, the vertical flanges being secured to the top side of the arm for sliding movement towards and away from one another to accommodate mailboxes of different widths.

6. The mailbox holder as defined in claim 5 in which the post, the stake and the arm are fabricated from metal tubing; the post, the arm and the diagonal support are rigidly welded together; and the holder further comprises a pair of caps secured to the open tubular ends of the post and the arm.

7. The mailbox holder as defined in claim 5 in which the lower support includes four stabilizers rigidly secured at equal angular spacing to the upper half of the stake.

8. The mailbox holder as defined in claim 5 in which the stabilizers extend outwardly from the stake to approximately the circular diameter of the flange when viewed from above.

9. The mailbox holder as defined in claim 5 in which the stabilizers have a semi-circular profile when viewed from the side.

10. The mailbox holder as defined in claim 5 in which the bracket includes left and right hand angle-brackets comprising (i) horizontal plates with inside edges and outside edges and (ii) the left and right vertical flanges secured to the outside edges of the plates, the plates having front and back sets of cross-wise slots, the plates being secured to the arm with threaded fasteners installed through said slots and into the top side of the arm for sliding movement of the vertical flanges towards and away from one another.

* * * * *